US005655230A

United States Patent [19]

Corbin

[11] Patent Number: 5,655,230

[45] Date of Patent: Aug. 12, 1997

[54] AUXILIARY URINAL RETROFIT FOR A COMMODE

[76] Inventor: John H. Corbin, 7608 Fawnhollow Cove, Austin, Tex. 78750

[21] Appl. No.: 589,417

[22] Filed: Jan. 22, 1996

[51] Int. Cl.[6] ..... E03D 13/00

[52] U.S. Cl. ..... 4/342; 4/340; 4/301

[58] Field of Search ..... 4/340, 341, 342, 4/301, 307, 144.1, 252.1

[56] References Cited

U.S. PATENT DOCUMENTS

| | | | |
|---|---|---|---|
| 3,500,480 | 3/1970 | Michal, Jr. | 4/341 |
| 4,137,579 | 2/1979 | Soler | 4/311 |
| 4,282,611 | 8/1981 | O'Day | 4/301 |
| 5,153,947 | 10/1992 | Markles | 4/252.1 |
| 5,299,328 | 4/1994 | Walega | 4/342 |
| 5,390,374 | 2/1995 | Hubrig et al. | 4/301 |

*Primary Examiner*—Henry J. Recla
*Assistant Examiner*—Charles R. Eloshway
*Attorney, Agent, or Firm*—Joseph F. Long

[57] ABSTRACT

An auxiliary urinal retrofittable to an existing commode. The urinal is connected to a base plate which is placed between the base of the toilet and the floor and allows the urinal to drain liquid into the drain used by the commode. The urinal has a cup shaped head with a flush ring therein and a free standing semi-rigid drain line connected thereto and to the base plate to effect drainage. The semi-rigid drain line has limited travel segments to allow the user to manually position the urinal head to an optimum use position. In an alternative embodiment, the urinal is housed in a cover and placed against a wall.

2 Claims, 8 Drawing Sheets

AUXILIARY URINAL RETROFIT FOR A COMMODE

BACKGROUND

This invention relates to an economical retrofit urinal attachment for a commode, designed particularly for male use. Quite commonly the male will raise both lids on a commode for urinary use. And quite commonly there will be objectionable splashing and perhaps objectionable allowance of both lids to remain in the upright position.

The objectives of our invention include:

a) a commode retrofit primarily for male urinary use, b) a variable height unit to allow use by a child as well as an adult, c) a unit with flush ring to use a minimum amount of water while completely flushing the unit, d) having a unit that requires minimal space, e) having a unit that requires no commode modification, f) having a unit that has no lines or pipes inside the commode and, g) having a minimum water usage unit.

Our unit comprises a) a base plate that would normally be sized to fit under the base of the commode or in one embodiment protrude a short distance out from under the commode base. Base plates in each embodiment have a central opening that fits over the commode drain and an opening leading through the base plate to provide a drain into the commode drain, b) a water tight connection to the opening in the edge of the base plate or to an opening in the base plate to mount a multiple connector pot, c) an open cup shaped alternate urine receptacle with a flush ring therein connected with a limited travel semi-rigid drain line that leads to a vapor trap within the connector pot, d) a water flush line leading from the water supply valve to the alternate urinal receptacle through a sidewall of the connector pot and through the drain line from the alternate urinal receptacle to a push button valve in the line to the flush ring.

There are a number of patents intended to solve the problems we've outlined. The closest prior art we've found appears to be U.S. Pat. No. 4,137,579 issued to Soler Feb. 6, 1979. Our invention differs markedly in that in Soler the drain line from the alternate urine receptacle leads through the commode wall or through the floor to tie into the commode drain or through the wall to tie into the commode vent line. Our unit with a cup shaped urine receptacle and a free standing limited travel drain line or fixed drain line leading through a base plate installed under a commode differs markedly and is a marked improvement over Soler in appearance, ease of use, and ease of installation.

SUMMARY OF THE INVENTION

An auxiliary or alternate urinal retrofit for a commode comprising:

a) a base plate normally being about one inch thick with a minimum thickness of about one half inch. This plate is preferably made of a plastic such as Corian™ with a milled decorative edge and sized to match a commode base. The base would have a central opening and seal rings to seal between the commode base and base plate and between the base plate and a top portion of a floor drain. There is an opening through the base from the central opening to an exterior edge. This opening leads to the rear of the base in one embodiment and to either side in other embodiments;

b) a multiple connector pot with an outlet drain opening connected to the opening through the base plate to drain to the commode drain;

c) a flush line with an inlet end tied into the water supply line leading into the water tank for the commode and leading through a wall of the multiple connector pot with a water tight seal;

d) an open cup shaped alternate urine receptacle with a flush ring therein, connected to a rigid or semi-rigid drain line with the lower end of the drain line connecting with a limited travel flexible connector. The semi-rigid flexible connector may be made by snapping together identical piping segments that are ball shaped on one end and bell shaped on the other end with each segment having a limited travel. The segments are encased in a flexible sheath to improve appearance. In one embodiment sufficient segments are used to allow movably adjusting the open alternate urinal cup shaped head from about one foot to about three feet from the floor. The lower end of the flexible drain tube threads or otherwise connects through a wall of the multiple connector pot and curves upward to an open end to form a vapor trap. The water flushing line that is furnished water from the inlet water supply valve to the commode tank and comes through the sidewall of the multiple connector pot is about one fourth inch in diameter and threads upward through the vapor trap and through the limited travel flexible connector and through the push button valve to the flush ring in the open cup shaped alternate urinal;

e) flush water and urine coming through the vapor trap and into the multiple connector pot drains through the base plate into the commode drain.

In a second embodiment the alternate urinal receptacle is fixed to the wall and drains through either a fixed or flexible drain line through the base plate to the drain under the commode. This embodiment allows flexibility in choosing a location for the unit.

DETAILED DESCRIPTION OF THE DRAWINGS

Figure 1:
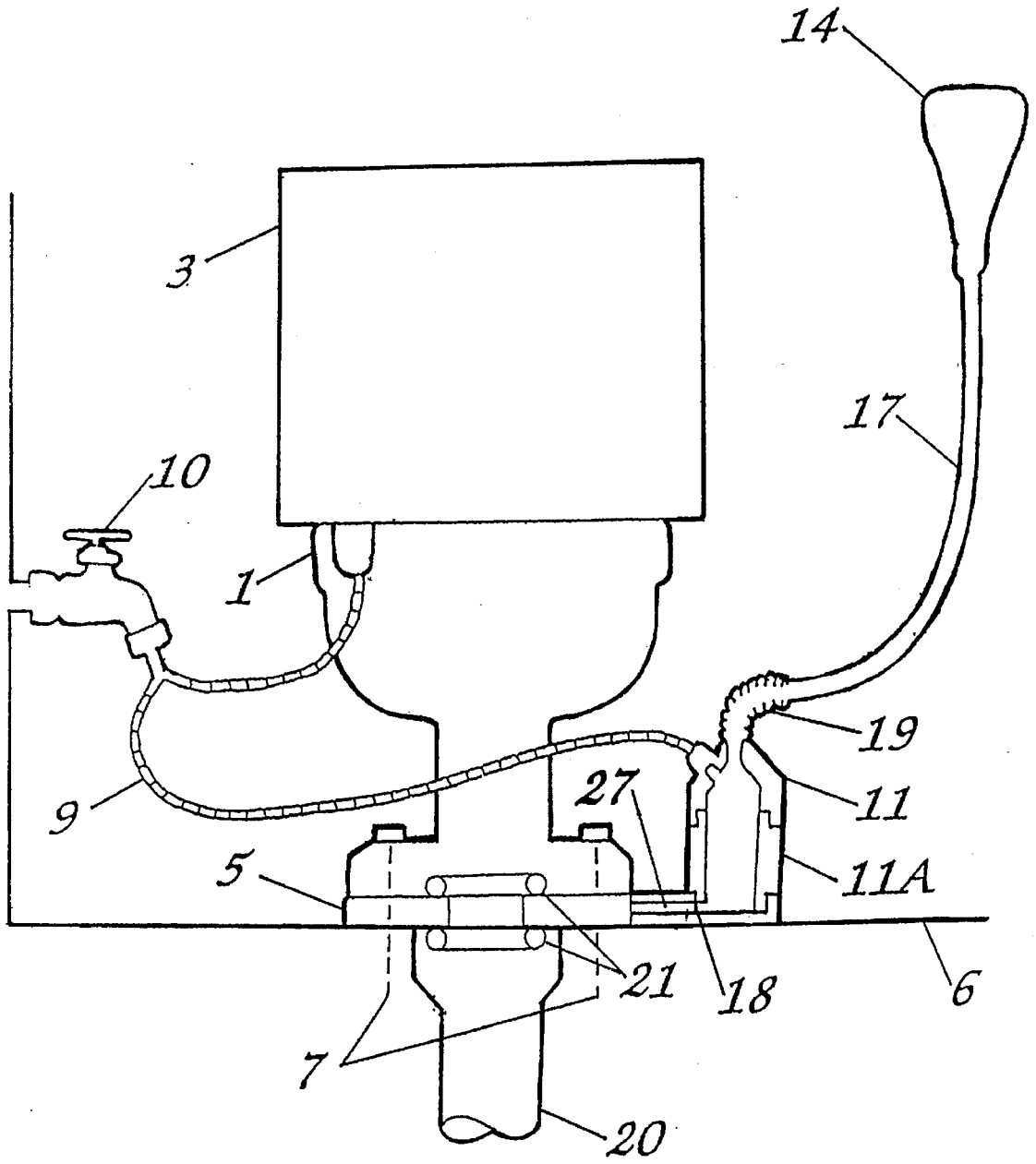
FIG. 1 shows a front view of a first embodiment of the unit in an operating position.
Figure 3:
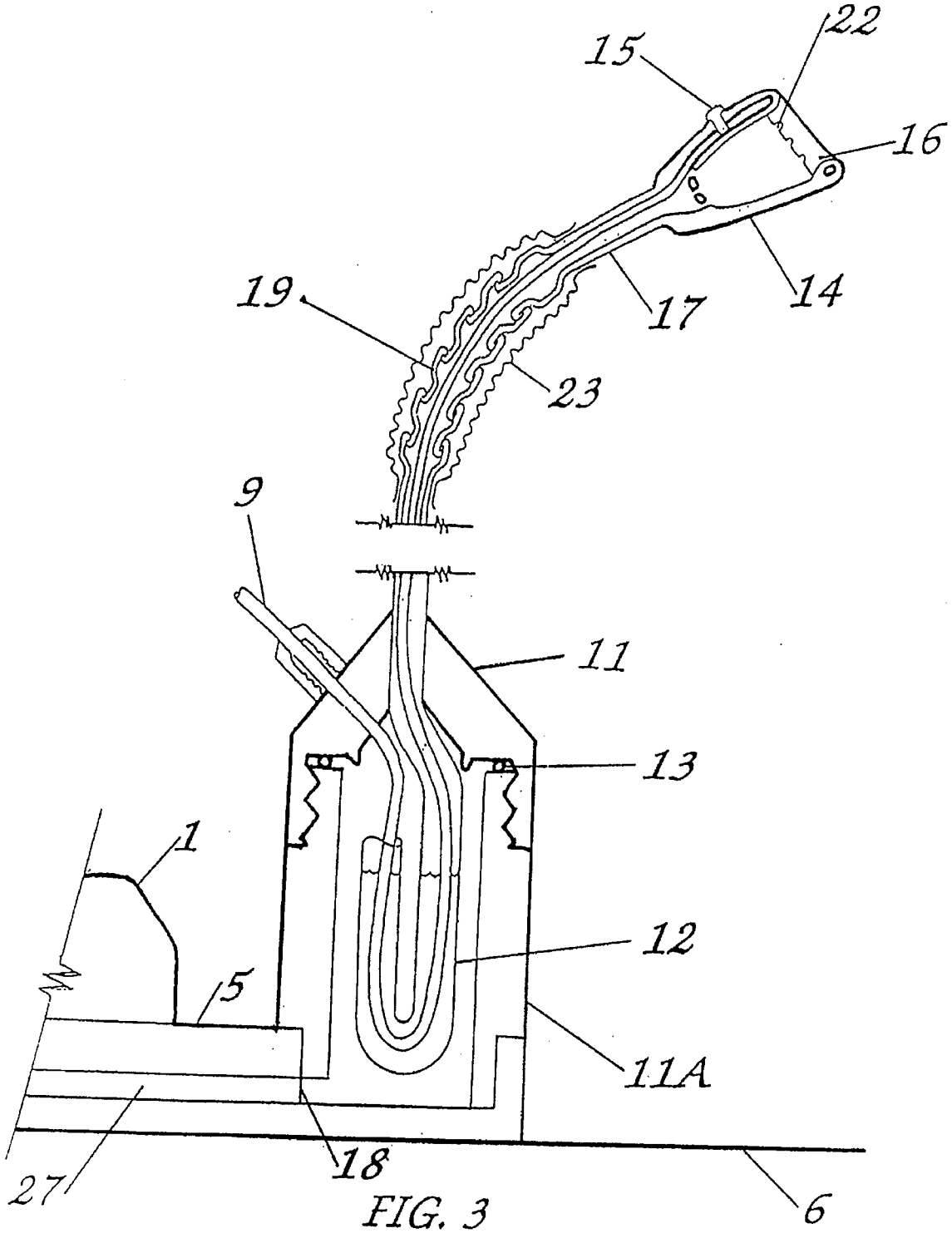
FIG. 3 shows a cross section indicating the details of construction of the major sections of the first embodiment.

The invention may best be described by reference to the drawings. In FIG. 1, in the first embodiment of the invention, commode 1 with water tank 3 is mounted over base plate 5. Seal rings 21 which are normally made of beeswax serve to make a water tight connection between the commode 1 and base plate 5 and between the base plate 5 and the floor drain 20. The alternate urinal or urinal head 14, normally an elongated cup shaped unit, connects with multiple connector pot 11 through a semi-rigid drain tube 17 and through a limited travel flexible connector tube 19 that leads into drain pot 11 with a water tight seal. Details of the drain tube are shown in FIG. 3. The multiple connector pot 11 is shown in more detail in FIG. 3. The multiple connector pot 11 acts as a drain pot that may be threaded or integrally formed with pot base 11 A and is connected with opening 27, FIG. 3 through base plate 5. Base 11 A may be either threaded or glued into opening 18. Bolts 7 go through the commode base, through the base plate 5, and through the floor to fasten the commode 1 firmly to the floor 6 in the usual fashion. The water flush line 9 for the alternate urinal is shown leading from the commode tank 3 water supply valve 10 and into the multiple connector drain pot 11. As discussed in more detail in FIG. 3 this flush line leads through a push button valve to flush the alternate urinal head 14 with each use.

Figure 2:
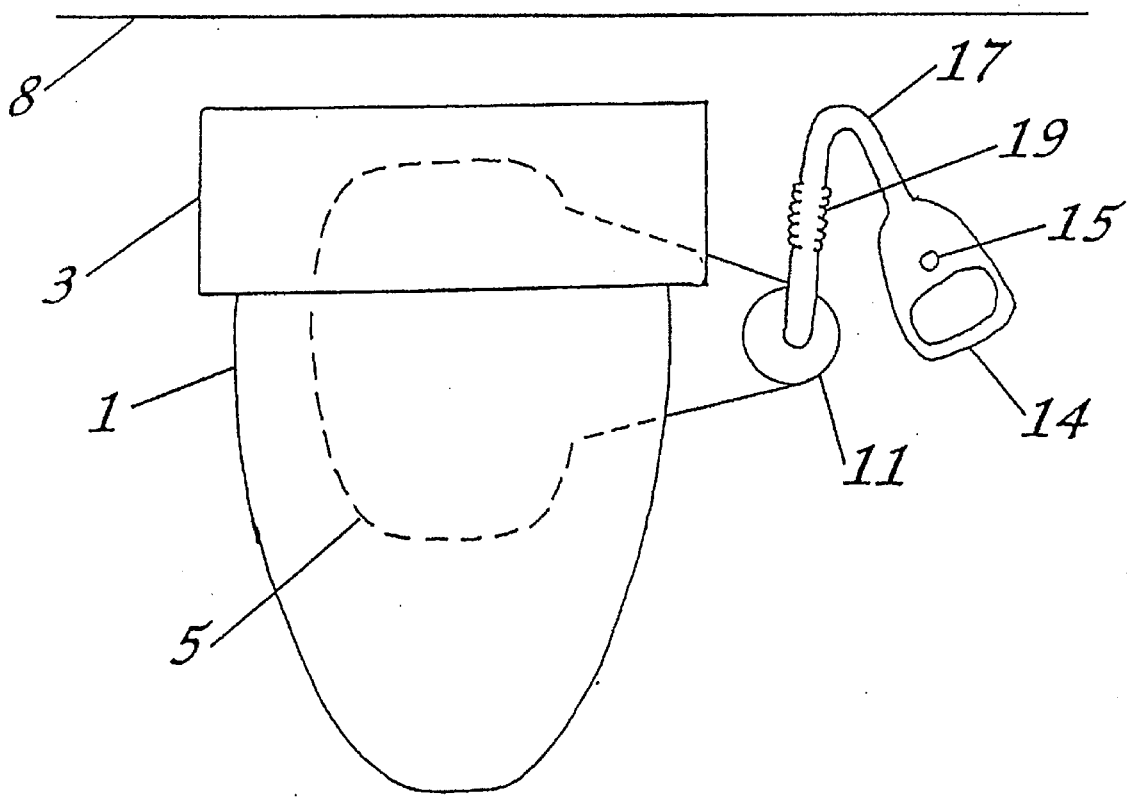
FIG. 2 shows a top view of the first embodiment.

In FIG. 2 we've shown a plan view of the first embodiment of the invention wherein the unit is mounted to one side of the commode. Base plate 5 extends out from below commode 1. This unit may be freestanding and in front of wall 8. Parts 3, 11, 14, 15, 17, and 19 are as previously discussed.

In FIG. 3 we've shown the multiple connector pot fabricated with an outer shell 11 threadably connected with base 11 A with an O ring seal 13 to form a water tight seal. The two parts could also be glued together after assembly of the interior trap 12 with flush line 9 running up through the trap. Flush line 9 may lead from any pressured water source and may conveniently lead from the inlet water valve 10 to commode tank 3, FIG. 1. Line 9 must make a water tight seal as it goes through the sidewall of multiple connector 11; this may be done in any of several known ways. We've shown a pressure ferrule and threaded cap to make this seal. The limited travel flexible drain tube 19 connects with a rigid portion of the drain line and extends through and makes a water tight seal with housing of the multiple connector 11; the rigid tube is bent upward to form trap 12. Water flows out the open end of trap 12 and through the line or opening 27 in base plate 5 to drain into the sewer under the commode. As shown water flush line 9 leads through trap 12, through limited travel flexible connector 19, up through semi-rigid tube 17, and through push button valve 15 into flush ring 16 with exit openings 22. With each use the user may flush the unit with a very small amount of water as compared with the amount of water normally used to flush a commode. The limited travel flexible connector 19 is made with identical snap together segments with segments shaped as indicated in the drawing. Each segment will move only about five degrees or less as the segment shape limits travel. With total height of the alternate urinal head about three feet sufficient segments are used to allow pulling the head downward to about one and one half feet for use by a small boy.

A flexible corrugated covering 23 is used over the limited travel section 19 to improve appearance.

The base of the multiple connector unit 11 A is preferably glued into opening 18 in base plate 5.

Figure 4:
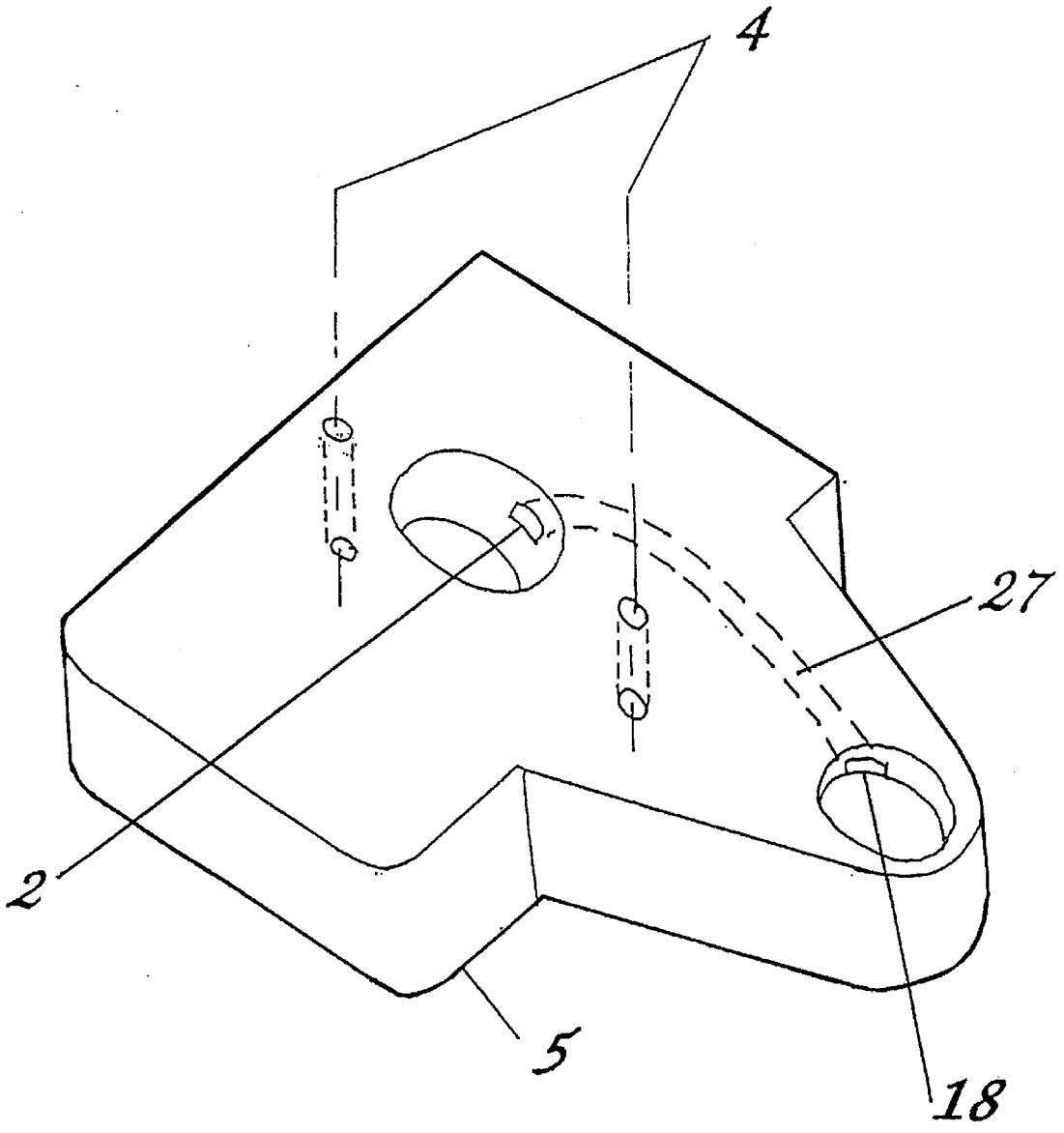
FIG. 4 shows details of the base plate for the first embodiment.

In FIG. 4 we've shown base plate 5 of the first embodiment shaped to protrude out from under the commode for mounting the unit at one side. The commode is mounted with bolts 7, FIG. 1 going through bolt holes 4. Commode drain opening 2 fits between the commode drain and the floor drain 20, FIG. 1. Multiple connector base 11 A, FIG. 3 may be glued into opening 18 with a drain opening from base 11 aligned to allow fluid to flow through line or channel 27 into commode drain opening 2 and thence into the floor drain.

Figure 5:
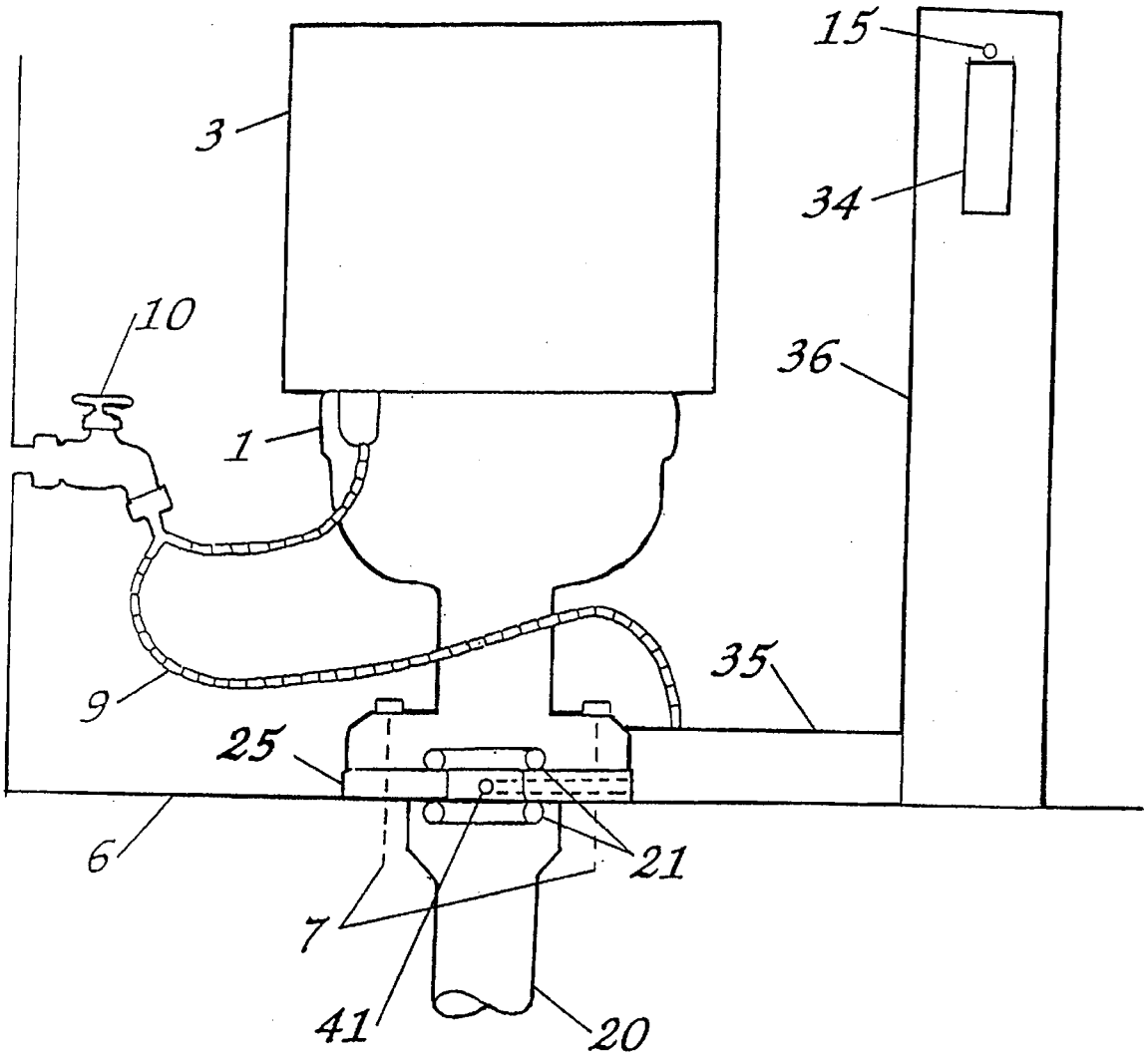
FIG. 5 shows a second embodiment mounted to the wall that ties into the base plate behind the commode.

We've shown a second embodiment of the invention in FIG. 5. Base plate 25 installs between the floor 6 and commode 1. Commode 1 with water tank 3 is fastened to the floor 6 with bolts 7. The base plate 25 is sealed between the commode drain and floor drain 20 with sealing rings 21 that are normally beeswax. Water flush line 9 leads from water inlet valve 10 under decorative cover 35 and 36 through flush valve 15 to allow manual flushing of the fixed alternate urinal opening 34 with each use.

Figure 6:
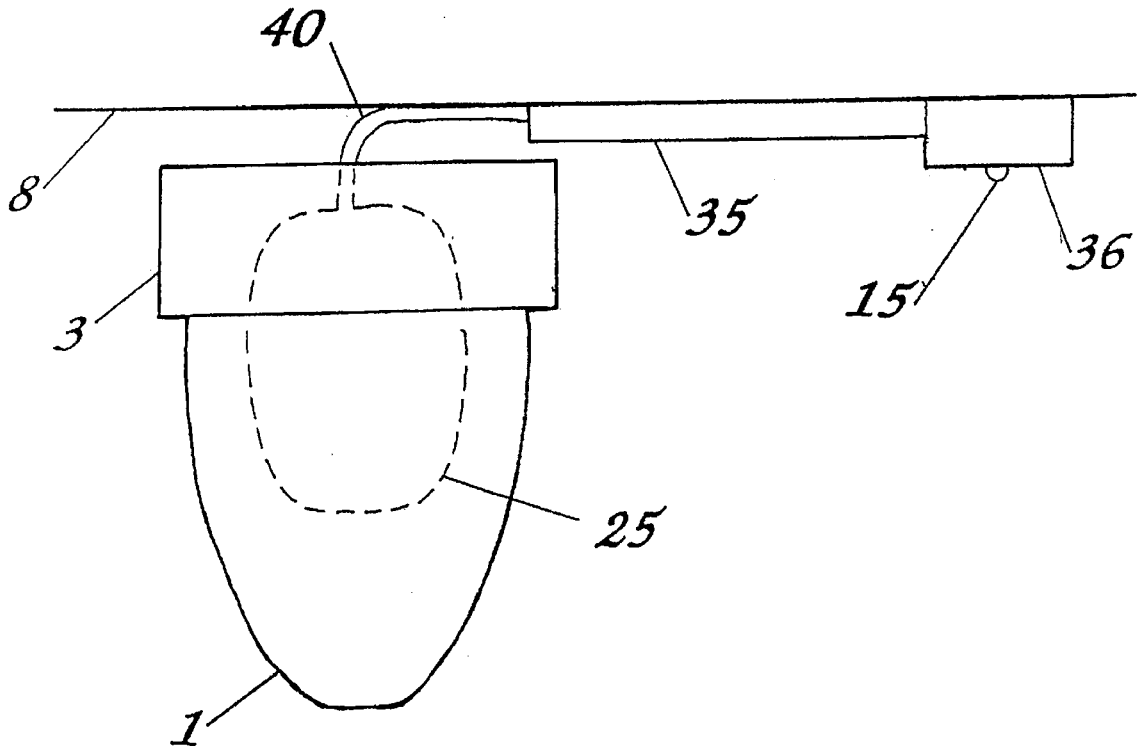
FIG. 6 shows a top view of the second embodiment.

In FIG. 6 we've shown a plan view of the second embodiment with base plate 25 shaped to have minimum visibility below commode 1 with drain line 40 tieing into the rear of the base plate 25. Line 40 may be either rigid or flexible allowing the unit enclosed in covers 35 and 36 to be installed on a back wall 8 near the commode 1 or on a wall at some distance from the commode. The manual flush valve or push button valve 15 would be visible from the front of the unit.

Figure 7:
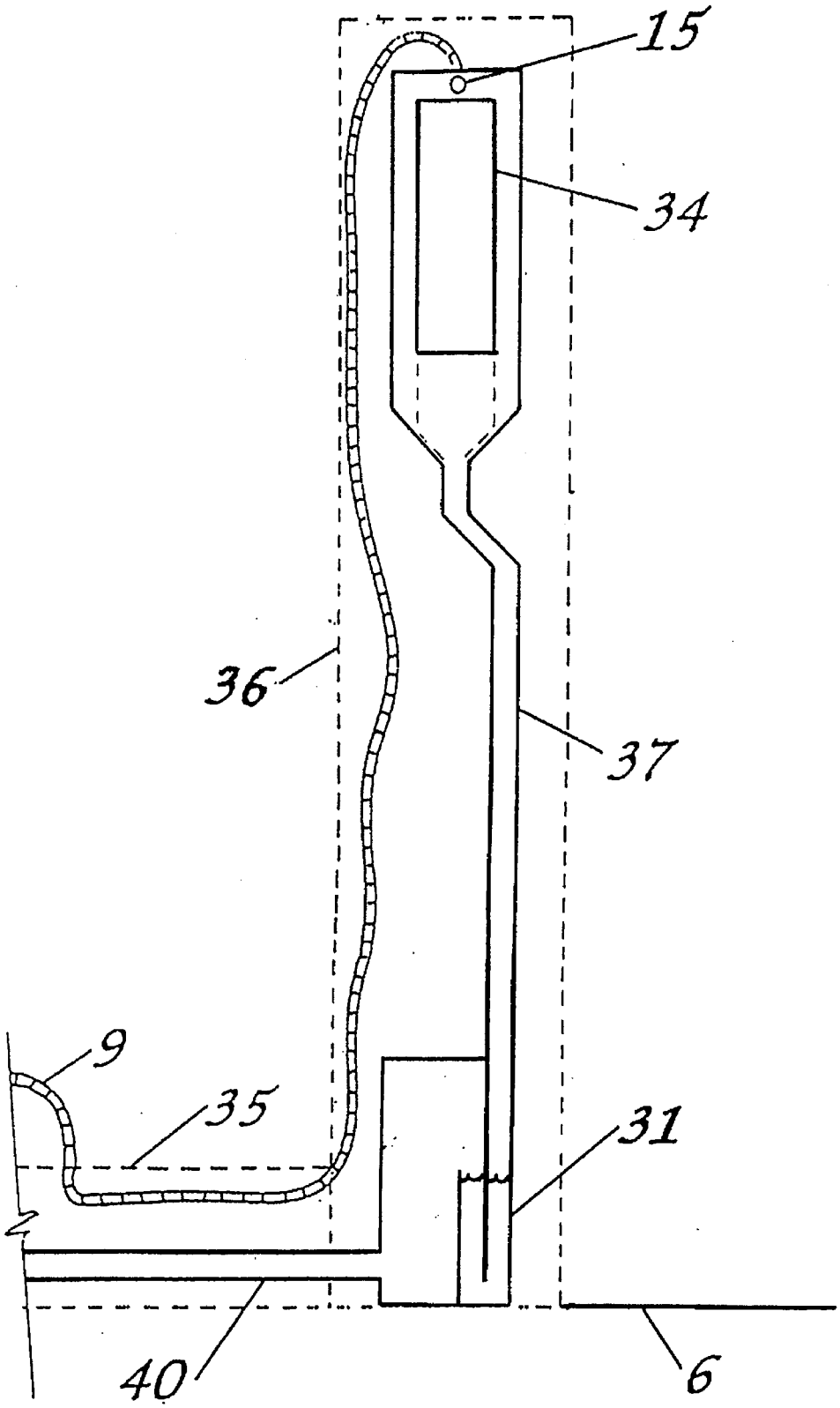
FIG. 7 shows details of the second embodiment of the urinal.

In FIG. 7 we've shown flush line 9 leading under cover 35 and cover 36 to flush valve 15, which is preferably a push button type valve to flush alternate urinal fixed elongated opening 34. Flush water follows urine through rigid pipe 37, through trap 31 to flow into drain line 40 and through base plate 25 into floor drain 20, FIG. 1.

Figure 8:
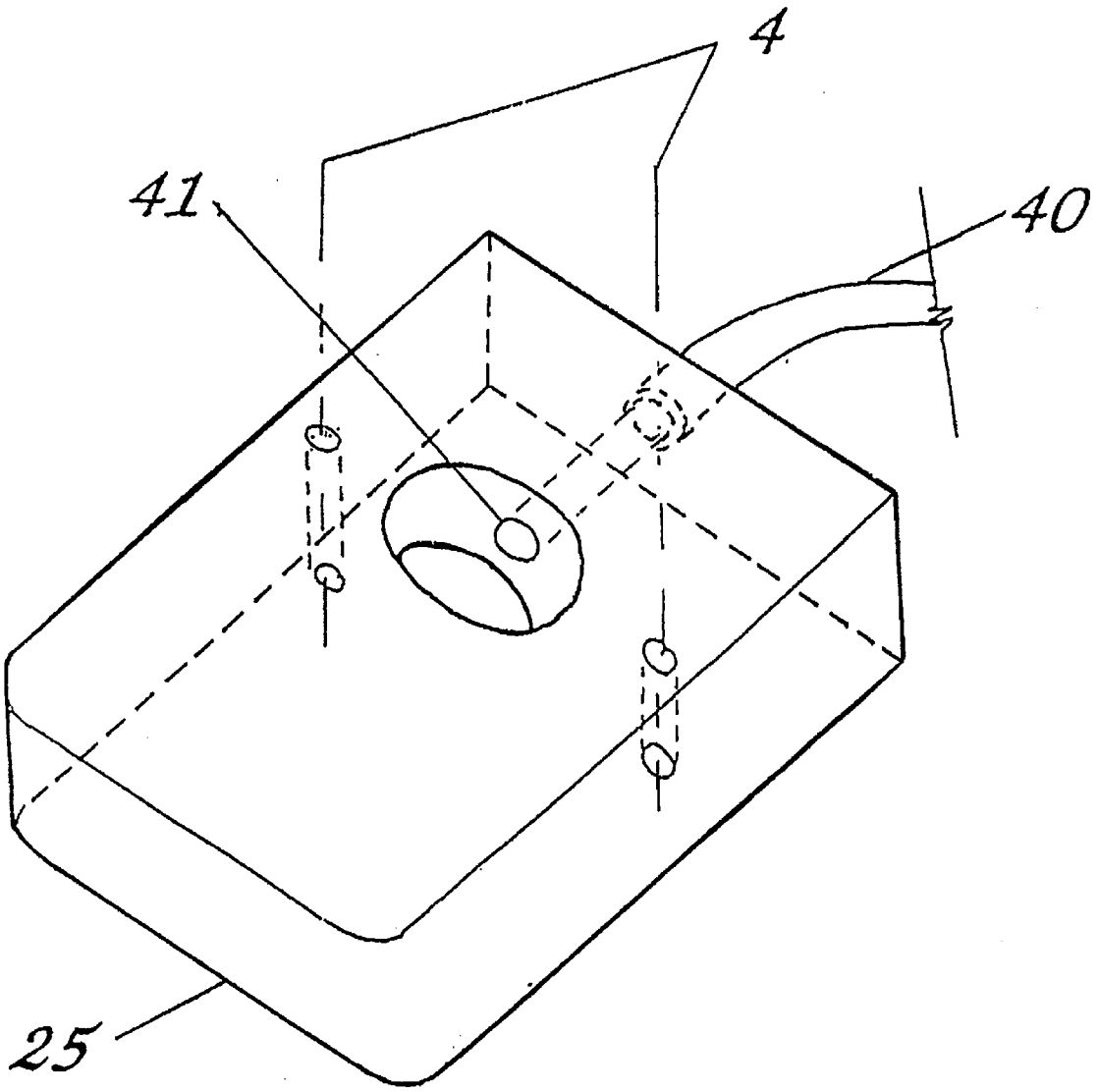
FIG. 8 shows details of the base plate for the second embodiment.

In FIG. 8 we've shown base plate 25 indicating that drain line 40 connects with interior channel 41 to allow fluid flow into floor drain 20, FIG. 5.

What is claimed is:

1. An auxiliary urinal adapted to be installed on an existing commode, said commode including a bowl and water tank, said urinal comprising:

a) a urinal receptacle retrofittable to said existing commode and adapted to be located beside, and spaced apart from, said water tank when said urinal is not in use, b) a rigid drain line having an inlet end, said urinal receptacle having an elongated opening connected to said inlet end of said rigid drain line, c) a vapor trap formed in said rigid drain line, d) means for draining said drain line, said means for draining connected to an exit end of said vapor trap, e) a base plate adapted to be installed between a base of said commode and a floor on which said commode rests, said base plate having a first opening therein adapted to overlie a commode drain hole in said floor and a second opening leading from an edge of said base plate through said base plate into said first opening, f) a flexible robe connecting said second opening to said means for draining, and g) a water flush line adapted for connection at one end thereof to a pressurized water supply and connected at the opposite end to said urinal receptacle by a push button valve mounted on said urinal receptacle, said push button valve admitting water from said water flush line to flush said urinal receptacle.

2. An auxiliary urinal as in claim 1 wherein said water flush line, said rigid drain line, said vapor trap, and the body of said urinal receptacle are mounted in a rigid cover which is adapted for placement against a wall.

* * * * *